United States Patent [19]

Sasaki

[11] 4,421,076

[45] Dec. 20, 1983

[54] STARTING AUXILIARY DEVICE FOR INTERNAL COMBUSTION ENGINE

[75] Inventor: Masahiro Sasaki, Fujisawa, Japan

[73] Assignee: Nissan Motor Co., Ltd., Kanagawa, Japan

[21] Appl. No.: 266,392

[22] Filed: May 22, 1981

[30] Foreign Application Priority Data

May 23, 1980 [JP] Japan ..... 55-70938[U]

[51] Int. Cl.[3] ..... F02N 17/00

[52] U.S. Cl. ..... 123/179 L; 123/499

[58] Field of Search ..... 123/179 L, 453, 495, 123/499, 407, 408, 576, 577, 578

[56] References Cited

U.S. PATENT DOCUMENTS

| | | | |
|---|---|---|---|
| 3,727,598 | 4/1973 | Knapp | 123/179 L |
| 3,810,451 | 5/1974 | Fales | 123/407 |
| 3,847,130 | 12/1974 | Miyoshi et al. | 123/179 L |
| 3,910,245 | 10/1975 | Okura | 123/179 L |
| 4,147,148 | 4/1979 | Ito et al. | 123/179 L |
| 4,216,757 | 8/1980 | Romann | 123/179 L |
| 4,241,709 | 12/1980 | Schellmann et al. | 123/407 |
| 4,242,992 | 1/1981 | Kawamula et al. | 123/179 L |

FOREIGN PATENT DOCUMENTS

| | | | |
|---|---|---|---|
| 532072 | 1/1941 | United Kingdom | 123/179 L |
| 924713 | 5/1963 | United Kingdom | 123/179 L |

*Primary Examiner*—Parshotam S. Lall

*Attorney, Agent, or Firm*—Lowe, King, Price & Becker

[57] ABSTRACT

An auxiliary starting device for an internal combustion engine, particularly for a diesel engine, comprises a driving device actuated by a starting switch to move a control lever of a fuel injection pump in a direction for increasing fuel for the engine for a predetermined period of time, thereby achieving an improved starting performance in any condition without any troublesome starting operation. The inventive device engages the control lever so as to permit further increases in fuel supply beyond a minimum value established thereby.

7 Claims, 6 Drawing Figures

STARTING AUXILIARY DEVICE FOR INTERNAL COMBUSTION ENGINE

BACKGROUND OF THE INVENTION

1. Field of the Invention

The present invention relates to an auxiliary starting device for increasing fuel supplied while starting an internal combustion engine, particularly diesel engine.

2. Description of the Prior Art

With conventional diesel engines, in order to improve their starting performance, there have been provided manually operated fuel means for increasing fuel supplies (e.g., a fast idle control device), wherein a driver rotates an operating knob in starting an engine to displace a control lever of a fuel injection pump by a predetermined angle, or wherein a driver presses an acceleration pedal to a half or fully opened position of a throttle valve of an engine, which position is maintained until the engine is sufficiently warmed up.

In many cases, however, the starting operations of the engines are so troublesome that the drivers are often obliged to neglect some of the normal starting operation sequences, with the result that there has been a tendency to adversely affect the starting performance of the engines.

SUMMARY OF THE INVENTION

It is an object of the invention to provide an improved auxiliary starting device for an internal combustion engine, which eliminates the above disadvantages of the prior art devices.

It is a further object of the invention to provide an auxiliary starting device for an internal combustion engine, which is capable of automatically increasing the fuel supplied while starting the engine.

The invention will be more fully understood by referring to the following detailed specification and claims taken in connection with the appended drawings.

DETAILED DESCRIPTION OF THE PREFERRED EMBODIMENT

Figure 1A:
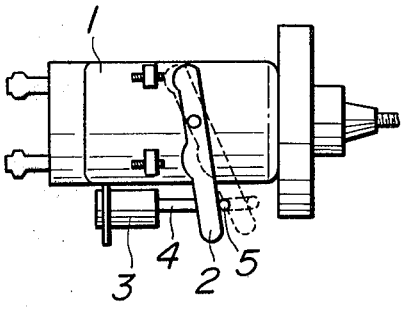
FIG. 1*a* is an elevation of an embodiment of the device according to the invention.
Figure 1B:
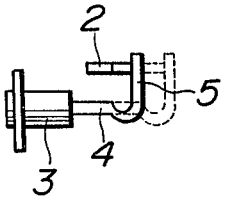
FIG. 1*b* is a view showing the driving device, operative rod, hook and control lever of the device shown in FIG. 1*a;*

Referring to FIGS. 1*a* and 1*b*, a fuel pump 1 for a diesel engine is provided with a control lever 2 for adjusting the amount of fuel to be injected. The control lever 2 is operatively driven by an accelerator pedal (not shown) linked thereto. At the time of starting, the control lever 2 is actuated by a predetermined angular displacement by means of driving means (a solenoid actuator 3 in this embodiment) for increasing the amount of fuel supplied while starting.

The driving means 3 is secured to a body of the fuel pump 1 and has an operative rod 4 adapted to freely engage and disengage from the control lever 2 by means of a hook 5 located at one end of the operative rod 4. When the operative rod 4 is retracted into the driving means 3, the control lever 2 is rotated by means of the hook 5 in a direction increasing the fuel corresponding to the displacement of the operative rod 4. If the control lever 2 is further rotated in the direction increasing the fuel, such a further rotation is not prevented.

Figure 2:
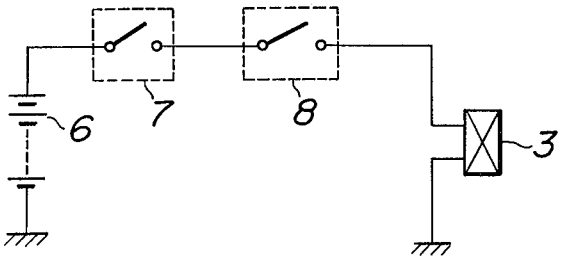
FIG. 2 is a circuit for controlling the device shown in FIG. 1.

The driving means (solenoid actuator) 3 is supplied with an electric current so as to be excited in starting the engine by means of a circuit (FIG. 2) which includes a battery 6, an engine key switch 7 and a starting switch 8, to which series circuit is connected the solenoid actuator 3.

With this arrangement, therefore, when the engine key switch 7 is switched on to close the starting switch 8 for starting the engine, the actuator 3 is supplied with a current to actuate the control lever 2 by the predetermined angular displacement through the operative rod 4 and hook 5 in the above manner, thereby automatically increasing the injected amount of fuel from the fuel injection pump 1.

When the engine has been smoothly started and warmed up, the starting switch 8 is switched off to release the restraint of the control lever 2, with the result that the amount of injected fuel is returned to that required to maintain normal idling revolutions of the engine.

Figure 3:
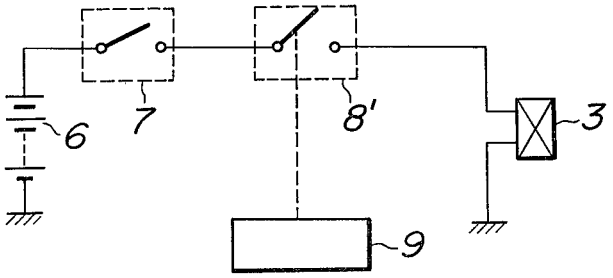
FIG. 3 is a another embodiment of the circuit for controlling the device shown in FIG. 1.

As shown in FIG. 3, a starting switch 8′ is adapted to be closed or opened by an automatic change-over circuit 9 which is operative for a period of time from starting of the engine to completion of the predetermined warming up of the engine, such as an afterglow timer circuit, an engine cooling water temperature detecting circuit, an exclusive timer circuit or an engine starter driving circuit, whereby the above operation can be completely automated.

A current is supplied by means of the afterglow to a glow plug for a predetermined period of time after starting the engine to heat a chamber to promote the warming up of the engine. For the same purpose, the engine cooling water temperature detecting circuit may be linked to the starting switch until the temperature of the cooling water for the engine is raised to a predetermined temperature, or the exclusive timer circuit may be used for increasing the fuel amount for any period of time, or the engine starter driving circuit may be used to increase the fuel amount while the engine starter is driven. In any case, the idling speed of engine revolution is securely returned to the normal value after the warming up of the engine without increasing the fuel consumption.

Figure 4A:
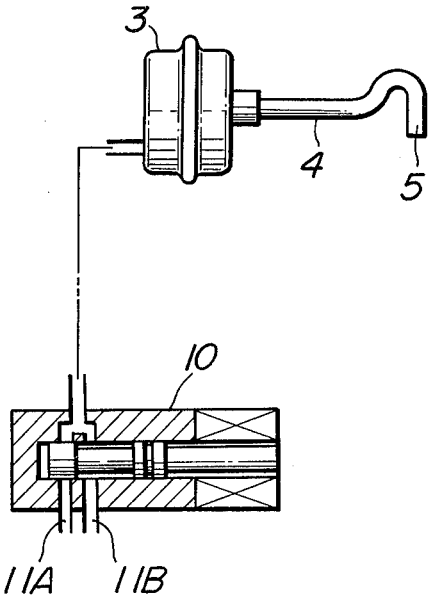
FIGS. 4*a* and 4*b* are sectional views illustrating another embodiment of the device according to the invention.
Figure 4B:
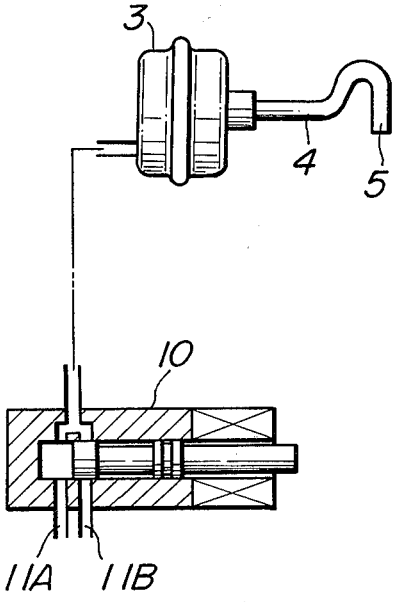

FIGS. 4*a* and 4*b* illustrate another embodiment of the invention, wherein driving means 3 comprises a diaphragm actuator, to which is supplied a negative pressure whose flow direction is controlled by means of a three-way electromagnetic valve 10. The atmospheric pressure and negative pressure from a negative pressure source (such as a vacuum tank) are selectively switched into passages 11A and 11B to be supplied to the diaphragm actuator 3 by means of the three-way electromagnetic valve 10. Signals for changing the electromagnetic valve position are supplied to the valve through the circuits shown in FIGS. 2 and 3.

As can be seen from the above description, according to the invention the fuel for starting an engine is automatically supplied by means of the driving means in starting the engine, thereby obtaining a good starting performance in any condition without a troublesome starting operation.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An auxiliary starting device for an internal combustion engine, said device comprising a control lever for increasing and decreasing fuel to be injected from a fuel injection pump and driving means actuated by a starting switch, said driving means including means for releasably engaging said control lever for actuating said control lever in a direction to increase an amount of fuel provided while starting said internal combustion engine to at least a predetermined amount, said last mentioned means operable for permitting said control lever to move in a direction increasing the amount of fuel beyond said predetermined amount.

2. An auxiliary starting device as set forth in claim 1, wherein said driving means comprises a solenoid actuator secured to a main body of said fuel injection pump and said means for releasably engaging said control lever comprising an operative rod of said actuator having a hook means at one end thereof.

3. An auxiliary starting device as set forth in claim 1, wherein said driving means comprises a diaphragm actuator and a three-way electromagnetic valve for controlling negative pressure to be supplied to said diaphragm actuator.

4. An auxiliary starting device as set forth in claim 1, wherein said starting switch is closed and opened by an automatic change-over circuit which is operative for a predetermined period of time from starting of the engine.

5. An auxiliary starting device as set forth in claim 4, wherein said automatic change-over circuit is a circuit selected from the group consisting of an afterglow timer circuit, engine cooling water temperature detecting circuit, exclusive timer circuit and engine starting driving circuit.

6. An auxiliary apparatus for starting an internal combustion engine having a fuel pump comprising:

control lever means movable in first and second directions for varying an amount of fuel pumped by the fuel pump in increasing and decreasing senses;

driving means responsive to a control switch, for increasing a minimum amount of fuel pumped by the fuel pump during starting of the engine;

said driving means including one-way engaging means for positively engaging said control lever to move said control lever in one direction for increasing the amount of fuel pumped by the fuel pump and to permit further motion of said control lever in said one direction while restricting motion of said control lever in the other direction, thereby to increase the amount of fuel pumped during engine starting, whereby further increase of the amount of pumped fuel by other devices independent of said driving means is permitted.

7. An auxiliary starting apparatus as recited in claim 6 wherein said one-way engaging means comprises a hooking means for engaging said control lever.

* * * * *